US010087027B2

(12) United States Patent
Takeda et al.

(10) Patent No.: US 10,087,027 B2
(45) Date of Patent: Oct. 2, 2018

(54) TAPE SUPPLYING METHOD AND TAPE SUPPLYING DEVICE

(71) Applicant: FUJIKURA LTD., Tokyo (JP)

(72) Inventors: Daiki Takeda, Sakura (JP); Masashi Ohno, Tokyo (JP); Satoru Shiobara, Sakura (JP); Masayoshi Yamanaka, Sakura (JP); Naoki Okada, Sakura (JP)

(73) Assignee: FUJIKURA LTD., Koto-ku, Tokyo (JP)

( * ) Notice: Subject to any disclaimer, the term of this patent is extended or adjusted under 35 U.S.C. 154(b) by 269 days.

(21) Appl. No.: 14/915,480

(22) PCT Filed: Sep. 24, 2014

(86) PCT No.: PCT/JP2014/075116
§ 371 (c)(1),
(2) Date: Feb. 29, 2016

(87) PCT Pub. No.: WO2015/050018
PCT Pub. Date: Apr. 9, 2015

(65) Prior Publication Data

US 2016/0214821 A1 Jul. 28, 2016

(30) Foreign Application Priority Data

Oct. 2, 2013 (JP) ..... 2013-207469

(51) Int. Cl.
*B65H 21/00* (2006.01)

(52) U.S. Cl.
CPC . *B65H 21/00* (2013.01); *B65H 2301/415016* (2013.01)

(58) Field of Classification Search
CPC ..... B65H 21/00; B65H 49/12; B65H 49/28; B65H 49/34; B65H 2301/415016;
(Continued)

(56) References Cited

U.S. PATENT DOCUMENTS 1,178,566 A * 4/1916 Wright ..... 242/128
3,285,446 A * 11/1966 Strickland ..... B41F 17/00 226/196.1
(Continued)

FOREIGN PATENT DOCUMENTS

DE 3702595 A1 8/1988
JP 59-32606 U 2/1984
(Continued)

OTHER PUBLICATIONS

Japanese Office Action for JP 2013-207469 dated Sep. 16, 2014.
(Continued)

*Primary Examiner* — William A. Rivera
(74) *Attorney, Agent, or Firm* — Sughrue Mion, PLLC

(57) ABSTRACT

To make a tape length that can be supplied at one time long, and to make it possible to directly supply a tape from a record wound tape.

A tape supplying method of this invention includes: connecting a tape end to an outer side of one record wound tape of a first record wound tape and a second record wound tape and a tape end to an inner side of another record wound tape, by matching a surface and a rear surface of the tapes; and after the connecting, supplying a tape of the first record wound tape and the second record wound tape from a tape end of the first record wound tape to an opposite side of a side that has been connected to the second record wound tape.

8 Claims, 13 Drawing Sheets

(58) Field of Classification Search
CPC ..... B65H 2301/415066; B65H 2701/1846; B65H 2701/37
See application file for complete search history.

(56) References Cited

U.S. PATENT DOCUMENTS

| | | | | |
|---|---|---|---|---|
| 3,889,891 | A | 6/1975 | Walker | |
| 4,610,408 | A * | 9/1986 | Box | B21C 47/003 225/103 |
| 4,720,054 | A * | 1/1988 | Hood | B21C 47/16 242/420.6 |
| 4,844,360 | A * | 7/1989 | Winter | B65H 16/021 211/171 |
| 6,726,142 | B2 * | 4/2004 | Abba | B65H 49/34 242/566 |

FOREIGN PATENT DOCUMENTS

| | | | |
|---|---|---|---|
| JP | 61-10269 | U | 1/1986 |
| JP | 62-185659 | A | 8/1987 |
| JP | 03-193213 | A | 8/1991 |
| JP | 2004-307083 | A | 11/2004 |
| JP | 2008-087871 | A | 4/2008 |
| JP | 4212399 | B2 | 1/2009 |
| WO | 2013/005087 | A1 | 1/2013 |

OTHER PUBLICATIONS

Japanese Office Action for JP 2013-207469 dated Dec. 2, 2014.
International Search Report for PCT/JP2014/075166 dated Nov. 11, 2014.
Communication dated Feb. 22, 2016 from the Taiwanese Intellectual Property Office in counterpart application No. 103133559.
International Preliminary Report on Patentability issued from the International Bureau in counterpart international application No. PCT/JP2014/075166, dated Apr. 14, 2016.
Communication dated Feb. 21, 2017 issued by the Japanese Patent Office in corresponding JP application No. 2015-016687.
Communication dated Oct. 9, 2016, from the State Intellectual Property Office of the P.R.C. in counterpart Chinese application No. 201480049667.9.

* cited by examiner

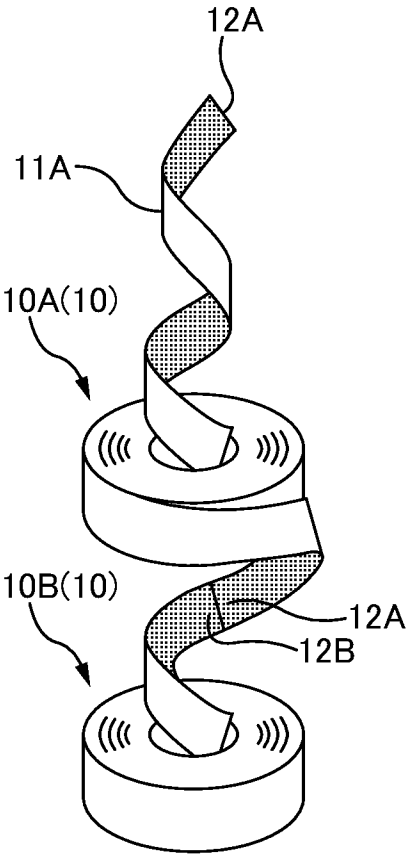
FIG. 2B
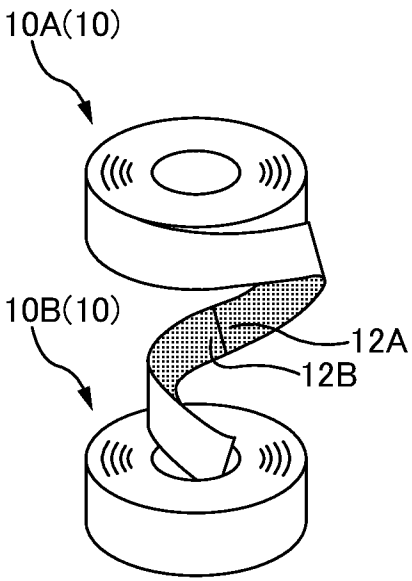
FIG. 2A
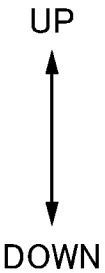

TAPE SUPPLYING METHOD AND TAPE SUPPLYING DEVICE

CROSS REFERENCE TO RELATED APPLICATIONS

This application is a National Stage of International Application No. PCT/JP2014/075166 filed Sep. 24, 2014, claiming priority based on Japanese Patent Application No. 2013-207469 filed Oct. 2, 2013, the contents of all of which are incorporated herein by reference in their entirety.

TECHNICAL FIELD

The present invention relates to tape supplying methods and tape supplying devices.

BACKGROUND

As a method of winding a long tape, there are known a "record winding" method and a "traverse winding" method. "Record winding" is a method of winding a tape so as to overlap the tape, while aligning side edges of tapes (ends of tapes in the width direction), without shifting a winding position of the tape with respect to a core (for example, a paper core) in an axial direction. "Traverse winding" is a method of winding a tape around a wide core helically, while shifting the winding position of the tape with respect to the core in the axial direction.

A tape that has been record wound (below, record wound tape) is generally made by winding a wide whole cloth around a wide core and slitting (cutting) such into a predetermined width. On the other hand, a tape that has been traverse wound (below, traverse wound tape) is generally made by winding again a tape around a wide core (for example, a bobbin), and connecting (joining) tape ends to wind a long tape. Thus, the traverse wound tape has increased winding steps compared to the record wound tape, thus the traverse wound tape is generally higher in cost.

In traverse winding, the helical direction is reversed in an end part of the core, thus curls are easily formed in the traverse wound tape. On the other hand, although the record wound tape is not easily formed with curls, generally the tape length per one tape is short compared to the traverse wound tape.

In a manufacturing line that supplies a tape continuously, the manufacturing line is temporarily stopped each time the tape runs out, and a tape end of a new record wound tape is connected (a new record wound tape is added), and the manufacturing line is restarted and the above is repeated. Thus, when the tape length is short like the record wound tape, efficiency of the manufacturing line decreases.

In PTL 1, it is proposed that a tape is temporarily accumulated (stored) in a tape accumulator, and while the accumulated tape is being supplied the tape is connected with a tape end of a new tape pad (corresponds to a record wound tape). With this tape accumulator, when connecting the tape end of the new tape, the manufacturing line does not have to be stopped, thus decrease in efficiency of the manufacturing line can be suppressed.

CITATION LIST

Patent Literature

PTL 1 Japanese Utility Model Application Examined Publication No. 61-10269

SUMMARY

Technical Problem

In PTL 1, every time the tape of the tape pad (corresponds to the record wound tape) is used up a certain amount, a worker connects the tape end of the new tape pad to the tape. In other words, every time the tape is used up a certain amount, the worker goes to the tape accumulator, and performs connecting work of the tape ends. In the case where the tape length is short as in the record wound tape, since the tape length that can be supplied at one time is short, the connecting work of the tape ends needs to be performed frequently. As a result, it becomes necessary to secure people to perform the connecting work of the tape ends and the like. Thus, preferably the tape length that can be supplied at one time is long.

As a method of making the tape length that can be supplied at one time long, there is a method of temporarily winding again to a bobbin an amount of a plurality of the record wound tapes while adding the tape (temporarily making what corresponds to a traverse wound tape), and supplying the tape from the bobbin to the manufacturing line. In this method, however, it is necessary to wind again the tape to the bobbin, thus the number of processes increases. To suppress the number of processes, it is preferable to directly supply the tape from the record wound tape to the manufacturing line.

The present invention has an objective to make a tape length that can be supplied at one time long, and to be able to directly supply a tape from a record wound tape.

Solution to Problem

An aspect of this invention to achieve the above objective is a tape supplying method including:

connecting a tape end to an outer side of one record wound tape of a first record wound tape and a second record wound tape and a tape end to an inner side of another record wound tape, by matching a surface and a rear surface of the tapes; and after the connecting, supplying a tape of the first record wound tape and the second record wound tape from a tape end of the first record wound tape to an opposite side of a side that has been connected to the second record wound tape.

Other features of this invention will become clear from the description of the specification and the drawings to be described later.

Advantageous Effects of Invention

According to this invention, a tape length that can be supplied at one time is made long, and a tape from a record wound tape can be directly supplied.

BRIEF DESCRIPTION OF DRAWINGS

FIG. 2A is an explanatory view of a connecting method of a tape end 12 in a first embodiment. FIG. 2B is an explanatory view of a tape supplying method of two record wound tapes 10 that have been connected as shown in FIG. 2A.

DESCRIPTION OF EMBODIMENTS

Figure 1C:
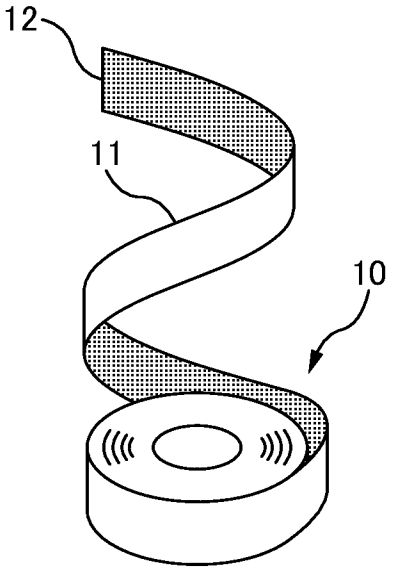
FIG. 1B and FIG. 1C are explanatory views of a manner of drawing out a tape 11 from one record wound tape 10.

At least the following matters will become clear from the description of the specification and the drawings to be described later.

A tape supplying method will become clear including:

connecting a tape end to an outer side of one record wound tape of a first record wound tape and a second record wound tape and a tape end to an inner side of another record wound tape, by matching a surface and a rear surface of the tapes; and after the connecting, supplying a tape of the first record wound tape and the second record wound tape from a tape end of the first record wound tape to an opposite side of a side that has been connected to the second record wound tape.

According to such a tape supplying method, a tape length that can be supplied at one time can be made long, and a tape can be directly supplied from a record wound tape.

It is preferable that, during the connecting, the tape end to the outer side of the first record wound tape and the tape end to the inner side of the second record wound tape are connected, and during the supplying, supplying the tape from the first record wound tape, from the tape end to an inner side of the first record wound tape. In this way, the tape does not easily get tangled when supplying the tape.

It is preferable that, during the connecting, a tape end that has been drawn out from an inner side of the second record wound tape that has been placed on a lower side mounting stand is passed through an opening of an upper side mounting stand, with the tape end of the second record wound tape that has been passed through the opening placed to an outer side from a lower surface of the first record wound tape, the first record wound tape is placed on the upper side mounting stand in a manner sandwiching the tape of the second record wound tape, and the tape end to an outer side of the first record wound tape and the tape end to an inner side of the second record wound tape that is placed to an outer side from a lower surface of the first record wound tape are connected. In this way, the connecting work of the tapes to each other becomes easy.

It is preferable that, during the supplying, the tape is supplied by the first record wound tape and the second record wound tape being rotated. In this way, a twist in the tape can be suppressed.

It is preferable that, during the supplying, a twist of the tape that has been drawn out in a direction perpendicular to an upper surface and a lower surface of the first record wound tape is detected, and the first record wound tape and the second record wound tape are rotated according to a detection result of the twist. In this way, a twist of the tape can be more appropriately suppressed.

It is preferable that, the tape is supplied through an annular gap formed between a guiding shaft that passes through hollow parts of the first record wound tape and the second record wound tape and an annular guiding ring arranged to surround a periphery of the guiding shaft, and the twist of the tape is detected by detecting the tape in the annular gap. In this way, a twist of the tape can be detected.

It is preferable that, by sandwiching with a pair of rollers the tape that has been drawn out from one of the first record wound tape and the second record wound tape, when a twist is made in the tape the twist is accumulated to an upstream side of the rollers. In this way, a case where the twisted tape is supplied can be suppressed.

It is preferable that, during the supplying, drawing out the tape in a direction parallel to an upper surface and a lower surface of the first record wound tape from an outer side of the first record wound tape, while rotating the first record wound tape and the second record wound tape, and after the first record wound tape has been used up, the second record wound tape is moved to a position where the first record wound tape had been placed, and while the second record wound tape is rotated, the tape is drawn out from an outer side of the second record wound tape. In this way, the position of the source of the tape can be fixed.

It is preferable that, a tape supplying device including: amounting stand on which a first record wound tape and a second record wound tape are to be placed; and a sending mechanism to send a tape, wherein a tape end to an outer side of one record wound tape of the first record wound tape and the second record wound tape placed on the mounting stand and a tape end to an inner side of another record wound tape are connected, by matching a surface and a rear surface of the tapes, and the sending mechanism supplies a tape of the first record wound tape and the second record wound tape from a tape end of the first record wound tape to an opposite side of a side that has been connected to the second record wound tape.

According to such a tape supplying method, the tape length that can be supplied at one time can be made long, and the tape can be directly supplied from the record wound tape.

It is preferable that, a tape supplying device, including: a guiding shaft that passes through hollow parts of the first record wound tape and the second record wound tape; a guiding ring arranged to surround a periphery of the guiding shaft; a sensor to detect the tape in an annular gap that has been formed between the guiding shaft and the guiding ring; and a rotation mechanism that rotates the first record wound tape and the second record wound tape, wherein, while the tape is drawn out in a direction perpendicular to an upper surface and a lower surface of the first record wound tape, the rotation mechanism is driven according to a detection result of the sensor, and the first record wound tape and the second record wound tape are rotated in a direction that solves a twist of the tape. In this way, a twist of the tape can be more appropriately suppressed.

It is preferable that, wherein a pair of rollers that sandwiches the tape that has been drawn out from one of the first record wound tape and the second record wound tape is provided, and the rollers are rotated to supply the tape. In this way, a case where the twisted tape is supplied can be suppressed.

It is preferable that, wherein the device includes a rotation mechanism that rotates the first record wound tape and the second record wound tape, and a moving mechanism that moves a position of the second record wound tape, wherein, while the first record wound tape and the second record wound tape are rotated with the rotation mechanism, the tape is drawn out in a direction parallel to an upper surface and a lower surface of the first record wound tape from an outer side of the first record wound tape, after the first record wound tape has been used up, the second record wound tape is moved with the moving mechanism to a position where the first record wound tape had been placed, and while the second record wound tape is rotated with the rotation mechanism, the tape is drawn out from an outer side of the second record wound tape. In this way, the position of the source of the tape can be fixed.

(Reference Description) Record Wound Tape

Figure 1B:
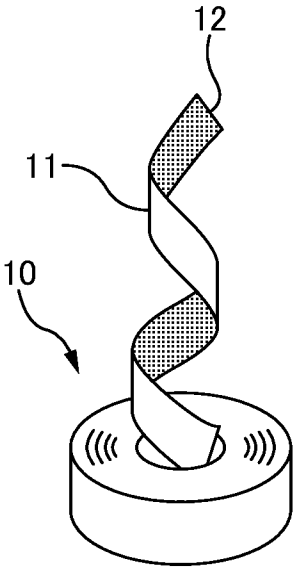
Figure 1A:
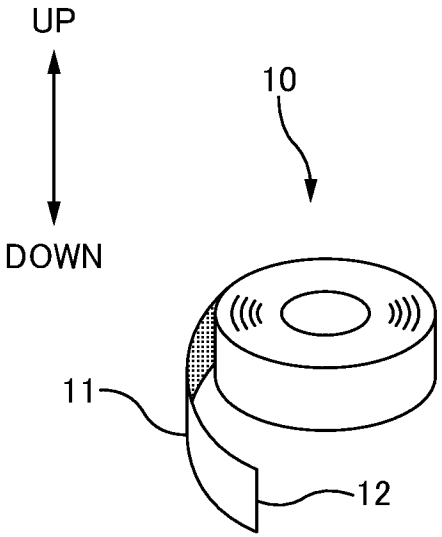
FIG. 1A is an explanatory view of a record wound tape 10.

FIG. 1A is an explanatory view of a record wound tape 10.

The record wound tape 10 is a tape that has been wound in an overlapping manner with side edges of a tape 11 (ends of the tape 11 in the width direction) in an aligned manner. The record wound tape 10 is manufactured by such as record winding the tape 11 to a core with a similar width as the tape width, or is manufactured by slitting (cutting) at a predetermined width a wide whole cloth that has been wound around the wide core. The tape 11 is made from a material, for example, such as paper, a nonwoven fabric, and a resin film, but the material of the tape 11 is not limited to the above.

Here, a record wound tape 10 without a core (a coreless type record wound tape) is to be used. The core does not have to be included from the time of manufacture of the record wound tape 10, or the core may be removed from the record wound tape 10 during use.

In the below description, an up-down direction is defined, as shown in FIG. 1A. In other words, a direction parallel to an axis of the record wound tape 10 is an "up-down direction", and of the two surfaces configured from the side edges of the tape 11, a side to be a placing surface is referred to as "down" and the opposite side is referred to as "up". Further, a side farther from the axis of the record wound tape 10 may be referred to as an "outer side" and the opposite side may be referred to as an "inner side". Further, a surface to an outer side of the tape 11 may be referred to as a "face" or a "surface", and a surface to an inner side of the tape 11 may be referred to as "rear" or a "rear surface". In the figure, the rear surface of the tape 11 has been shaded.

FIG. 1B and FIG. 1C are explanatory views of the manner of drawing out the tape 11 from one record wound tape 10. FIG. 1B shows the manner of drawing out upwards the tape end 12 (an end part of the tape 11) from an inner side of the record wound tape 10. FIG. 1C shows the manner of drawing out upwards the tape end 12 from an outer side of the record wound tape 10.

As shown in FIG. 1B and FIG. 1C, the tape 11 can be drawn out without moving the record wound tape 10. When drawing out upwards (a direction perpendicular to an upper surface or a lower surface of the record wound tape 10) the tape 11 with the record wound tape 10 remaining fixed, however, as shown in FIG. 1B and FIG. 1C, the tape 11 becomes helical, and a twist occurs in the tape 11.

When drawing out as in FIG. 1B, the tape 11 to the most inner side of the record wound tape 10 (the tape 11 to be drawn out) receives the force toward the inner side, thus the tape 11 to be drawn out and the tape 11 immediately to the outer side of such a tape 11 easily comes apart. On the contrary, when drawing out as in FIG. 1C, the tape 11 to the outermost side of the record wound tape 10 (the tape 11 to be drawn out) receives the force toward the inner side, thus not only such a tape 11, but also the tape 11 to the inner side are involved, and a few winds of the tape 11 are drawn up together. Thus, the drawing out method in FIG. 1B has an advantage that the tape 11 does not tangle easily, compared with the drawing out method in FIG. 1C.

The record wound tape 10 generally has a short tape length per tape compared to a traverse wound tape. Thus, by merely drawing out the tape 11 from one record wound tape 10 as shown in FIG. 1B and FIG. 1C, the tape length that can be supplied at one time is short. As will be described below, by connecting tape ends 12 of record wound tapes 10 to each other in advance, the tape length that can be supplied at one time can be made long.

(1) First Embodiment

(1) Summary

FIG. 2A is an explanatory view of a connecting method of tape ends 12 in a first embodiment. Here, a mounting stand 20 (to be described later) of a record wound tape 10 is not taken into consideration. In the below description, a reference character relating to an upper side record wound tape 10 may be added a character "A", and a reference character relating to a lower side record wound tape 10 may be added a character "B".

Two record wound tapes 10 are arranged to the upper side and the lower side. With the upper side record wound tape 10A, an outer side tape end 12A is drawn out. With the lower side record wound tape 10B, an inner side tape end 12B is drawn out. Both of the drawn out tapes 11 are not twisted, and the tape ends 12 are connected to each other by matching the surface and the rear surface of the tapes 11. In other words, by matching an upper edge of the tape end 12A of the upper side record wound tape 10A and an upper edge of the tape end 12B of the lower side record wound tape 10B, and also by matching a lower edge of the tape end 12A of the upper side record wound tape 10A and a lower edge of the tape end 12B of the lower side record wound tape 10B, both of the tape ends 12 are connected.

It should be noted that, when connecting the tape ends 12, connecting methods such as, for example, heat sealing, compression bonding, adhering, ultrasonic bonding, and suturing are used. The connecting method to be adopted will vary depending on such as the material of the tape 11 and the objective of a manufacture (such as an optical cable to be described later). Further, here the tape ends 12 are directly connected to each other, but the tape ends 12 may be connected to each other indirectly via an intermediate such as a short intermediate tape.

FIG. 2B is an explanatory view of a tape supplying method of two record wound tapes 10 that have been connected as shown in FIG. 2A.

After the two record wound tapes 10 have been connected, the tape end 12A in the inner side of the upper side record wound tape 10A (the tape end 12A in the opposite side to the side that has been connected to the lower side record wound tape 10B) is drawn out upward, to supply the tape 11A from the inner side of the upper side record wound tape 10A. Then, when the upper side record wound tape 10A has been used up, the tape end 12B (the tape end 12B that has been connected to the upper side record wound tape 10A) to the inner side of the lower side record wound tape 10B is drawn out upward, and the tape 11B is supplied from the inner side of the lower side record wound tape 10B.

In this way, by connecting the tape ends 12 of the two record wound tapes 10 to each other in advance, even after the upper side record wound tape 10A has been used up, the tape 11B can be supplied continuously from the lower side record wound tape 10B. In this way, the tape length that can be supplied at one time can be made long, and the tape 11 from the record wound tape 10 can be directly supplied.

Further, since the tape is supplied from the inner side of the record wound tape 10, the tape 11 to be drawn out and a tape 11 immediately to the outer side of the tape 11 easily come apart, thus the tape 11 does not easily get tangled when supplying the tape 11.

(1) Connecting Method of Tape Ends

Figure 3C:
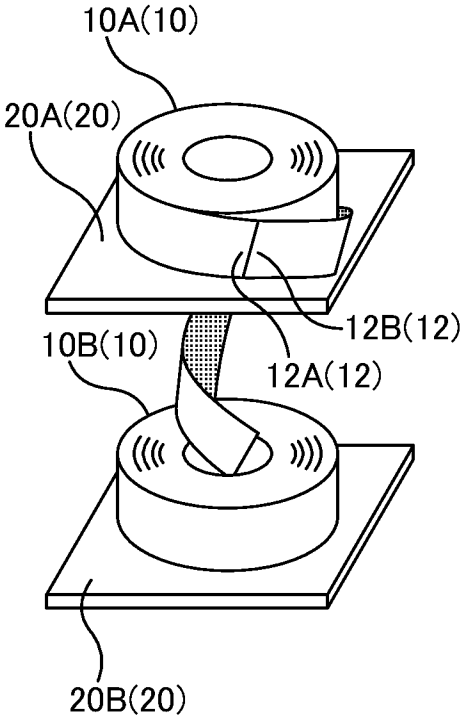
FIG. 3A to FIG. 3C are explanatory views of connecting processes of tape ends 12 in the first embodiment.
Figure 3B:
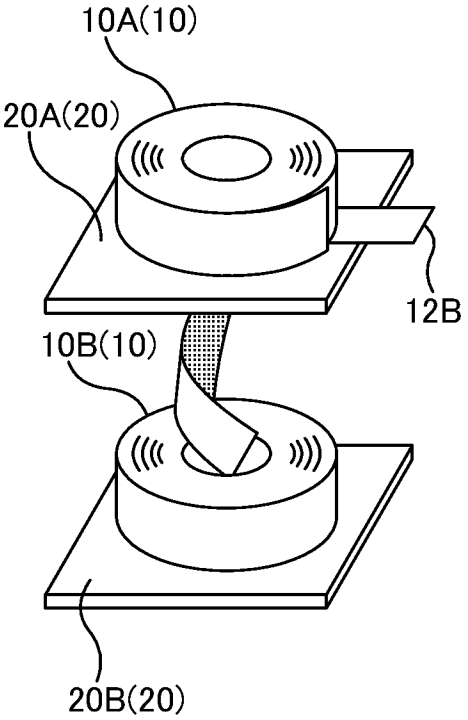
Figure 3A:
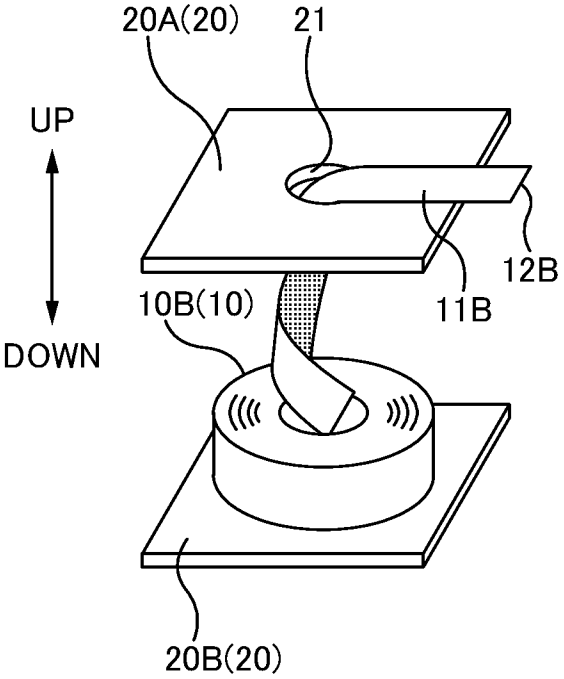

FIG. 3A to FIG. 3C are explanatory views of connecting processes of the tape ends 12 in the first embodiment.

First, as shown in FIG. 3A, the worker places the record wound tape 10B on a lower side mounting stand 20B. Then, as shown in FIG. 3A, the worker draws out the tape end 12B from the inner side of this record wound tape 10B, and passes this tape end 12B through an opening 21 of an upper side mounting stand 20A. At this time, the worker preferably arranges the tape 11B such that a surface of the tape 11B that has been passed through the opening 21 is in parallel with a surface of the mounting stand 20A. In this way, a process to place another record wound tape 10A so as to sandwich this tape 11B (the next process: refer to FIG. 3B) becomes easy.

Next, as shown in FIG. 3B, the worker places another record wound tape 10A on the upper side mounting stand 20A. At this time, as shown in FIG. 3B, with the tape end 12B of the lower side record wound tape 10B placed to the outer side from the lower surface of the upper side record wound tape 10A, the worker places the record wound tape 10A on the upper side mounting stand 20A while sandwiching the tape 11B of the lower side record wound tape 10B.

Next, as shown in FIG. 3C, the worker connects the tape end 12A to the outer side of the upper side record wound tape 10A and the tape end 12B place to the outer side from the lower surface of the record wound tape 10A (the tape end 12B to the inner side of the lower side record wound tape 10B) by matching the surface and the rear surface of the tapes 11. In this way, the connecting work of the tape ends 12 is completed.

It should be noted that, here the connection of two record wound tapes 10 has been described, but three or more record wound tapes 10 may be arranged in the up-down direction, and the record wound tapes 10 adjacent to the upper side and the lower side may be connected as similar to the above. In this case, the worker will perform the connecting work of the tape ends 12 in order from the record wound tape 10 to be placed on the lower side mounting stand 20.

Figure 4A:
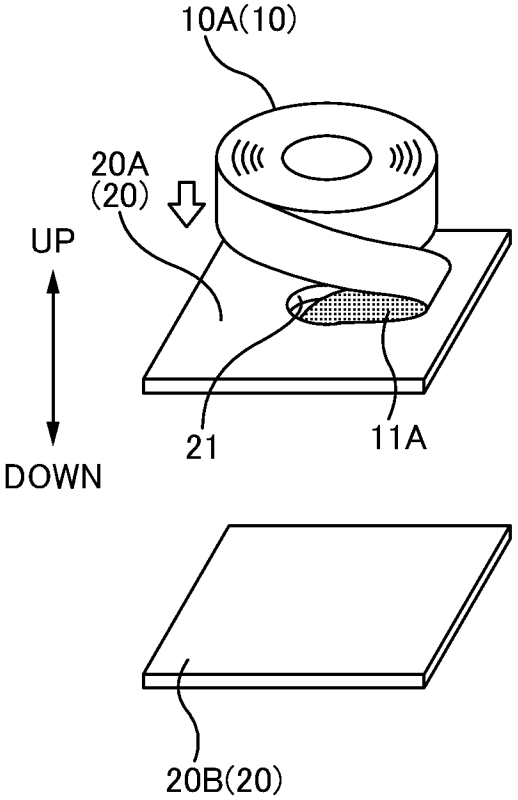
FIG. 4A to FIG. 4C are explanatory views of another connecting process in the first embodiment.
Figure 4B:
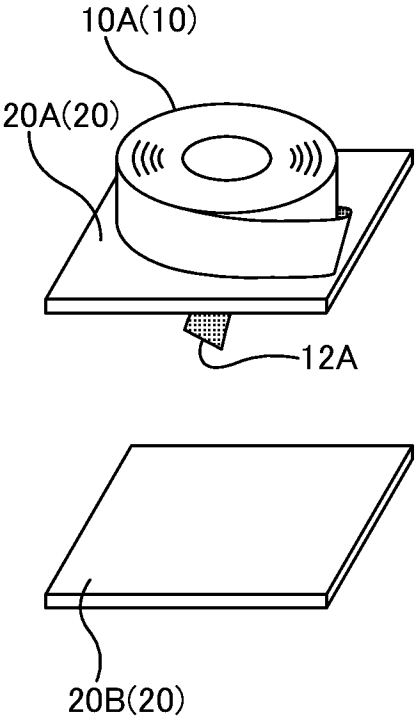
Figure 4C:
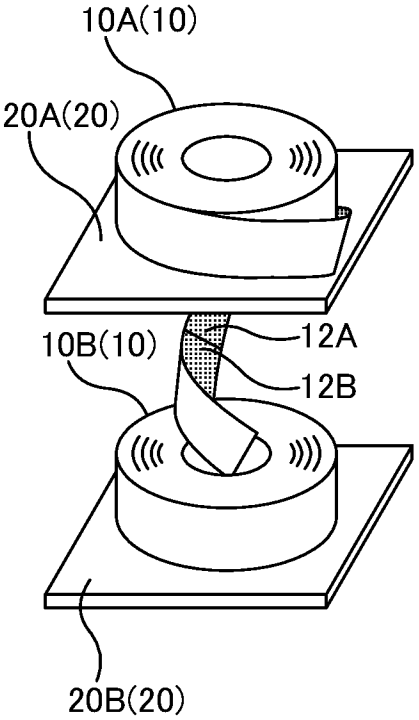

FIG. 4A to FIG. 4C are explanatory views of another connecting process in the first embodiment.

First, as shown in FIG. 4A and FIG. 4B, the worker places the record wound tape 10A on the upper side mounting stand 20A. At this time, as shown in FIG. 4A, the worker draws out the tape end 12A in the outer side of this record wound tape 10A, passes this tape end 12A through the opening 21 of the upper side mounting stand 20A, and, as shown in FIG. 4B, places the record wound tape 10A on the upper side mounting stand 20A such that the tape 11A that has been drawn out from the outer side is sandwiched with the lower surface of the record wound tape 10A.

Next, as shown in FIG. 4C, the worker places another record wound tape 10B on the lower side mounting stand 20B. Then, as shown in FIG. 4C, the worker draws out a tape end 12B from the inner side of this record wound tape 10B, and connects the tape end 12A to the outer side of the upper side record wound tape 10A and the tape end 12B to the inner side of the lower side record wound tape 10B by matching the surface and the rear surface of the tapes 11.

By the way, during the placing work shown in FIG. 4A and FIG. 4B, the worker is holding the record wound tape 10A, while having to pass the tape end 12A of the record wound tape 10A that is being held through the opening 21, and having to lower the record wound tape 10A downwards while that tape 11A is being sandwiched. In the case where the record wound tape 10A is heavy, there is a lot of strain on the worker, compared to the above-described placing work (refer to FIG. 3B).

Further, in the connecting work shown in FIG. 4C, the work is to be performed near the center of the mounting stand 20 (near the opening 21). Thus, in the connecting work shown in FIG. 4C, the worker to the outer side of the mounting stand 20 has to stretch his/her arm to near the center of the mounting stand 20 and perform the connecting work from a distant location, when compared to the connecting work described above (refer to FIG. 3C), thus there is a lot of strain on the worker, compared to the above described connecting work (refer to FIG. 3C).

Thus, it is more preferable to adopt the connecting processes shown in FIG. 3A to FIG. 3C, than the connecting processes shown in FIG. 4A to FIG. 4C.

(1) Supplying Method of Tape

Figures 5A, 5B, 5C:
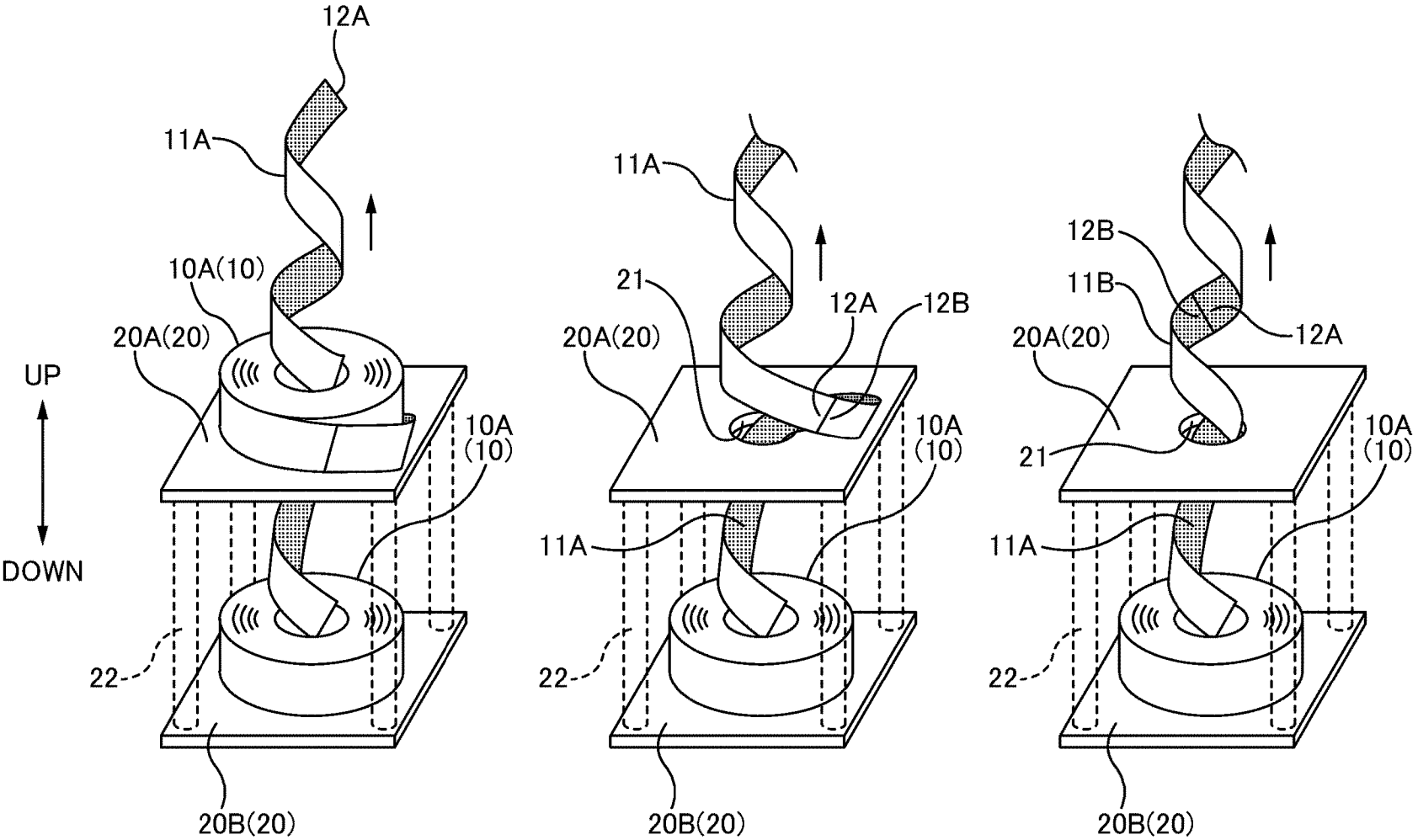
FIG. 5A to FIG. 5C are explanatory views of a supplying method of the tape 11 in the first embodiment.

FIG. 5A to FIG. 5C are explanatory views of a supplying method of the tape 11 in the first embodiment. Here, the two record wound tapes 10 are in the state shown in FIG. 3C, but the tapes may be in the state shown in FIG. 4C.

After the connecting work of the two record wound tapes 10 (refer to FIG. 3C), as shown in FIG. 5A, the tape end 12A to the inner side of the upper side record wound tape 10A (the tape end 12A to an opposite side to the side that has been connected to the lower side record wound tapes 10B) is drawn out upwards, to supply the tape 11A from the inner side of the upper side record wound tape 10A.

The upper side record wound tape 10A is placed on the mounting stand 20A such that the lower surface of the upper side record wound tape 10A sandwiches the tape 11B (refer to FIG. 5A). When the tape 11A of the upper side record wound tapes 10A is continuously supplied, however, the upper side record wound tape 10A will be used up, as shown in FIG. 5B, thus the tape 11B that had been sandwiched with the lower surface of the upper side record wound tapes 10A can also be supplied.

When the upper side record wound tapes 10A is used up, the tape end 12B to the inner side of the lower side record wound tape 10B (the tape end 12B that has been connected to the upper side record wound tape 10A) is drawn out upwards, and the tape 11B is supplied from the inner side of the lower side record wound tape 10B.

At this time, as shown in FIG. 5C, the tape 11B of the lower side record wound tape 10B is supplied through the inner side of the upper side mounting stand 20A (opening 21), without passing the outer side of the upper side mounting stand 20A. Thus, with this supplying method, as shown with dotted lines in the figure, support members 22 are arranged to the outer side of the record wound tapes 10, and the upper side mounting stand 20A can be supported with the lower side mounting stand 20B.

In this embodiment, the tape 11 is drawn out to the upper side with the two record wound tapes 10 arranged to the upper side and the lower side. In this way, when supplying the tape 11A from the upper side record wound tape 10A, and when supplying the tape 11B from the lower side record wound tape 10B, the source of the tapes 11 when seen from above will be in approximately the same position. Supposing that the tape 11 is drawn out to the upper side with the two record wound tapes 10 arranged to the left and the right, the position of the source of the tapes 11 when seen from the supply destination of the tape 11 (namely, from above) will vary. Thus, in the case that the tapes 11 are to be drawn out to the upper side, it is preferable to arrange the two record wound tapes 10 aligned in the up-down direction.

As shown in FIG. 5A to FIG. 5C, when the tape 11 is drawn out upwards while the record wound tape 10 remains fixed, the tape 11 becomes helical and a twist is made in the tape 11. There are cases, however, where a tape 11 without a twist needs to be supplied. In such a case, the tape 11 may be supplied while rotating the record wound tape 10, as will be described below.

(1) Tape Supplying Device

Figure 6:
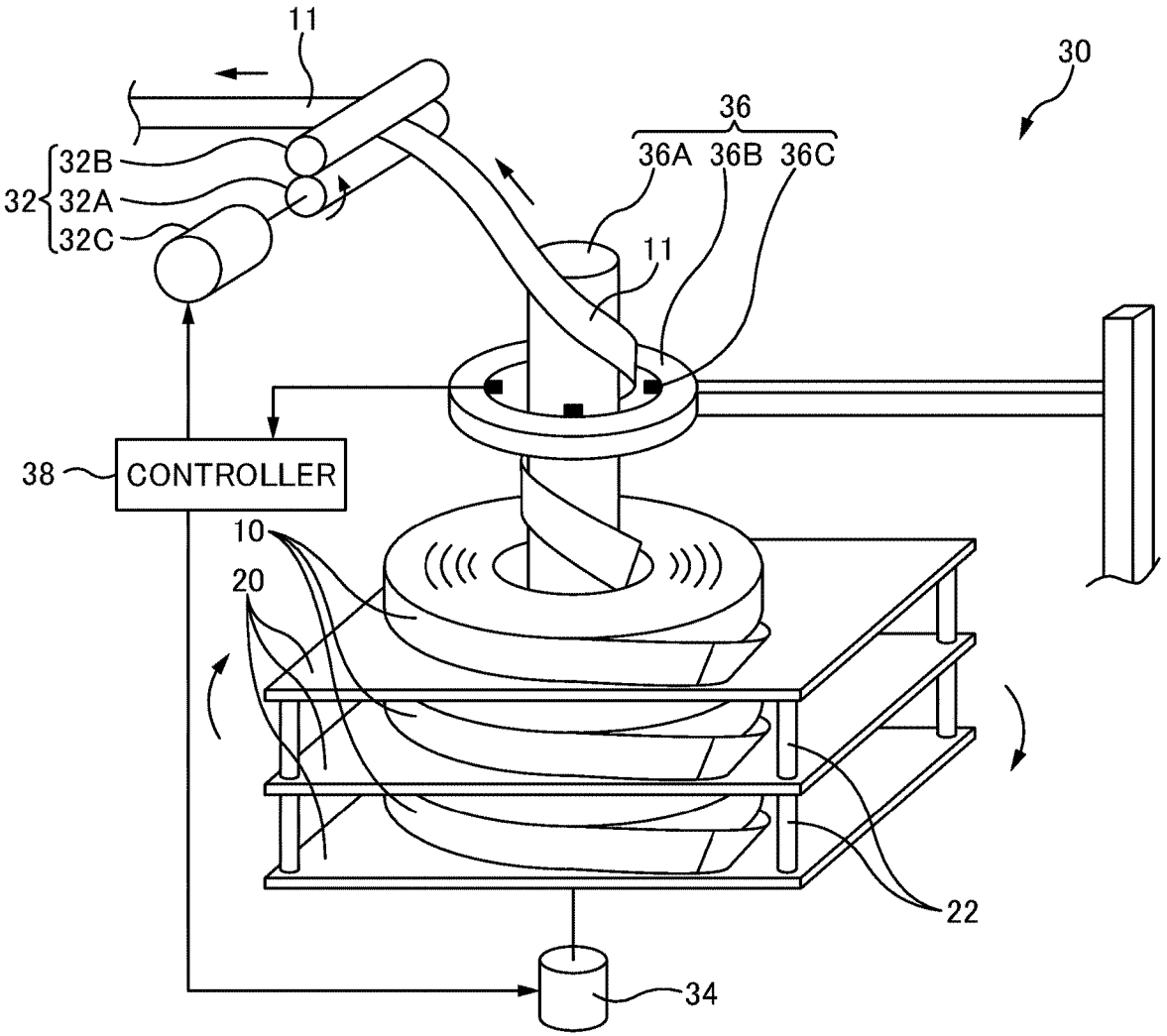
FIG. 6 is an explanatory view of a tape supplying device 30.

FIG. 6 is an explanatory view of a tape supplying device 30. The tape supplying device 30 has a sending mechanism 32, a mounting stand 20, a rotation mechanism 34, a twist detection part 36, and a controller 38.

The sending mechanism 32 is a mechanism to draw out the tape 11 from the upstream side record wound tape 10, and to send the tape 11 to the downstream side. The sending mechanism 32 includes, for example, a sending roller 32A and a driven roller 32B, and a sending motor 32C to rotate the sending roller 32A. The tape 11 is sandwiched between the sending roller 32A and the driven roller 32B, and the tape 11 is sent (supplied) by the sending roller 32A rotating. Since the tape 11 is sandwiched between the sending roller 32A and the driven roller 32B, a twist of the tape 11 is accumulated to the upstream side of the sending roller 32A and the driven roller 32B, and the twisted tape 11 being supplied to the downstream side is suppressed (however, when the number of twists exceeds an allowable twist rotation number (described later, refer to FIG. 8), there are cases where the twisted tape 11 is supplied to the downstream side).

The force to draw out the tape 11 from the record wound tape 10 is not applied directly from the sending roller 32A, but is applied from a tension device (not shown) that is to the downstream side than the sending roller 32A. The sending roller 32A has a role of applying back tension to the tape 11. The controller 38 drives the tension device that is not shown to control the supply amount and the supply speed of the tape 11, and further controls the torque of the sending roller 32A to control the tension of the tape 11. Further, the sending roller 32A has a role to guide sending of the tape 11.

It should be noted that, instead of applying the force to draw out the tape 11 from the record wound tape 11 from the tension device (not shown) that is to the downstream side than the sending roller 32A, the force may be applied directly from a rotational force of the sending roller 32A. In this case, the controller 38 will drive the sending motor 32C and control the rotation amount of the sending roller 32A, in order to control the supply amount and the supply speed of the tape 11.

The mounting stand 20 is a stand on which the record wound tape 10 is to be placed. Here, three mounting stands 20 are arranged aligned in the up-down direction. An opening 21 (not shown in FIG. 6, refer to FIG. 3A, FIG. 5B, and FIG. 5C.) is formed in the center of the mounting stands 20. The lowest mounting stand 20, however, does not have to have the opening 21. The mounting stands 20 that are aligned in the up-down direction are connected integrally with the support members 22 provided between each of the mounting stands 20.

Each of the mounting stands 20 is placed with the record wound tape 10. When focusing on two record wound tapes 10 that are aligned in the up-down direction of the three record wound tapes 10, as similar to FIG. 3A to FIG. 3C, the tape end 12 to the outer side of the upper side record wound tape 10 and the tape end 12 to the inner side of the lower side record wound tape 10 are connected by matching the surface and the rear surface of the tapes 11. In this way, the tape 11 of three record wound tapes 10 can be supplied at one time.

The mounting stands 20 are supported rotatably with the up-down direction as an axis with the openings 21 in the center. Since the three mounting stands 20 are connected integrally, the three mounting stands 20 will rotate integrally. When the mounting stands 20 rotate, the three record wound tapes 10 will also rotate together.

The rotation mechanism 34 is a mechanism to rotate the mounting stands 20. When the controller 38 drives a motor of the rotation mechanism 34, the mounting stands 20 rotate with the up-down direction as the axis. The rotation mechanism 34 will rotate the mounting stands 20 such that the rotation direction of the mounting stands 20 when seen from above are an opposite direction to a winding direction of the record wound tape 10 (the direction in which the tape 11 is wound from the inner side to the outer side of the record wound tape 10). Here, the winding direction of the record wound tape 10 when seen from above is an anti-clockwise direction, thus the rotation direction of the mounting stands 20 when seen from above is a clockwise direction.

The twist detection part 36 has a function to detect a twist in the tape 11. The twist detection part 36 includes a guiding shaft 36A, a guiding ring 36B, and detection sensors 36C.

The guiding shaft 36A is a member that guides the tape 11 that has been drawn out from the inner side of the record wound tape 10 to the upper side. The guiding shaft 36A is a round bar member extending in the up-down direction, and the shaft is arranged to penetrate through hollow parts in the center of the record wound tapes 10 and the openings 21 of the mounting stands 20. In order to arrange the guiding shaft 36A in this way, the guiding shaft 36A may be configured detachably and attachably, the guiding shaft 36A may be removed when setting the record wound tape 10 on the mounting stand 20, and the guiding shaft 36A may be attached to penetrate through the hollow parts in the center of the record wound tapes 10 and the openings 21 of the mounting stands 20 after the record wound tapes 10 have been set.

The guiding shaft 36A is positioned in the rotational center of the mounting stands 20. The guiding shaft 36A may rotate with the mounting stands 20, or may not rotate. When the guiding shaft 36A is rotated with the mounting stands 20, friction between the tape 11 and the guiding shaft 36A may be suppressed, thus there is an advantage that generation of abrasion powder and generation of static electricity can be suppressed.

The guiding shaft 36A protrudes to the upper side than the mounting stand 20 and the record wound tape 10 on the mounting stand 20. In this section protruding to the upper side, the guiding ring 36B is arranged to surround the periphery of the guiding shaft 36A. In other words, the guiding shaft 36A is arranged to penetrate through the hollow part of the annular guiding ring 36B.

The guiding ring 36B is an annular member that limits the moving range of the tape 11 to the inner side of the member. The guiding ring 36B is arranged to surround the periphery of the guiding shaft 36A, and the guiding ring 36B forms an annular gap with the guiding shaft 36A. The tape 11 that has been drawn out from the record wound tape 10 passes through the annular gap formed between the guiding shaft 36A and the guiding ring 36B and is to be supplied. The guiding ring 36B is fixed from the outside so as not to rotate.

The interval between the outer periphery of the guiding shaft 36A and the inner periphery of the guiding ring 36B is narrower than the width of the tape 11. In other words, the width of the gap between the guiding shaft 36A and the guiding ring 36B is narrower than the width of the tape 11. Thus, the tape 11 is prevented from twisting in the annular gap.

The detection sensor 36C is a sensor to detect the tape 11 in the gap between the guiding shaft 36A and the guiding ring 36B. The detection sensor 36C is arranged opposing the guiding shaft 36A in the inner side of the guiding ring 36B. Here, the detection sensor 36C is a sensor that detects the presence or absence of the tape 11. The detection sensor 36C may be a contacting type sensor that detects the presence or absence of the tape 11 by a contacting part such as a lever contacting the tape 11, or the sensor may be an optical type sensor that detects the presence or absence of the tape 11 with a detection light. The detection result of the detection sensor 36C is output to the controller 38.

Figure 7:
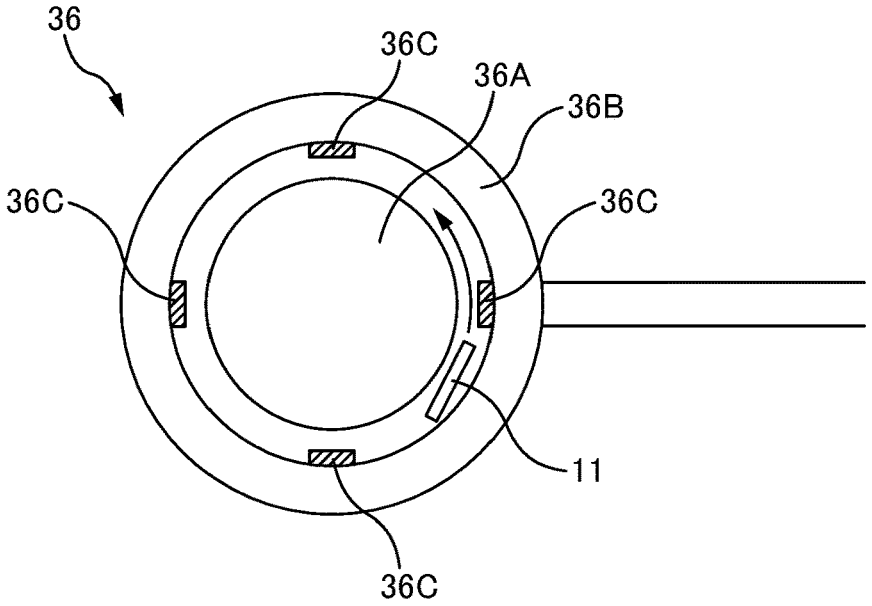
FIG. 7 is an explanatory view of movement of the tape 11 in a twist detection part 36.

FIG. 7 is an explanatory view of the movement of the tape 11 in the twist detection part 36. The drawing shows the twist detection part 36 and the position of the tape 11 in the annular gap of the twist detection part 36 (the gap between the guiding shaft 36A and the guiding ring 36B) when seen from above.

When the tape 11 is drawn out upwards from the inner side with the record wound tape 10 remaining in a fixed state, the position of the tape 11 in the annular gap of the twist detection part 36 moves in the same direction as the winding direction of the record wound tape 10 (here, anticlockwise). For example, when the tape 11 of one lap of the record wound tape 10 is drawn out, the tape 11 moves one lap in the annular gap, and as a result one twist of the tape 11 is made to the upstream side of the sending mechanism 32.

Then, based on the detection result of the twist detection part 36, the controller 38 rotates the mounting stands 20, to solve the twist of the tape 11. At this time, based on the detection result of the twist detection part 36, first the controller 38 detects a movement direction and a movement angle (a movement amount) of the tape 11 in the annular gap. For example, in the case where the detection sensors 36C are arranged at every 90 degrees when seen from the central axis as shown, the controller 38 can detect the movement direction of the tape 11 (clockwise or anticlockwise) and the movement of the tape 11 for the amount of 90 degrees by specifying the detection sensor 36C that has detected the tape 11 and the detection sensor 36C that has detected the tape 11 immediately before that detection. Next, the controller 38 rotates the mounting stands 20 for only the angle corresponding to the movement angle of the tape 11, in an opposite direction to the movement direction of the tape 11 in the annular gap. For example, when the controller 38 detects that the tape 11 has moved 90 degrees anticlockwise in the annular gap based on the detection result of the twist detection part 36, the mounting stand 20 is rotated 90 degrees clockwise. In this way, the twist of the tape 11 to the upstream side than the sending mechanism 32 is solved.

The twist of the tape 11 to the upstream side of the sending mechanism 32 is allowed to not be zero. This is because a certain amount of twist can be accumulated between the record wound tape 10 and the sending roller 32A. The number of twists that can be accumulated to the upstream side than the sending mechanism 32 (the allowable twist rotation number) is greater the longer the distance from the record wound tape 10 to the sending roller 32A (feeding distance).

Figure 8:
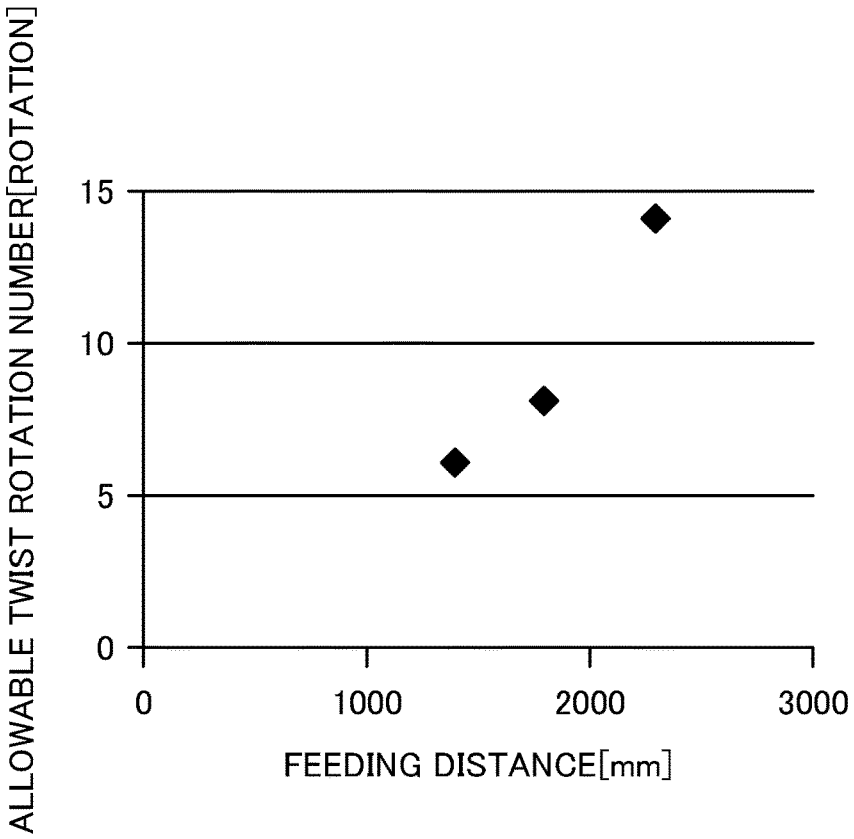
FIG. 8 is a graph showing a relationship between a feeding distance and an allowable twist rotation number.

FIG. 8 is a graph showing a relationship between the feeding distance and the allowable twist rotation number. The feeding distance in the horizontal axis is the distance from the record wound tape 10 to the sending roller 32A. The allowable twist rotation number in the vertical axis is a rotation number in which a twist is not sent out to the upstream side of the sending roller 32A. Here, a nonwoven fabric with a width of 20 mm and a thickness of 0.25 mm is being used. As shown in the graph, the allowable twist rotation number is greater the longer the feeding distance. This tendency is the same even when the material and the shape (width, thickness) of the tape 11 are changed.

In this way, the twist of the tape 11 to the upstream side of the sending mechanism 32 may be allowed to a certain degree, thus delay of response in rotation of the mounting stand 20 with respect to detection of twists with the twist detection part 36 is allowed for a certain degree. As a result, a certain amount of twist is sometimes made in the tape 11 to the upstream side of the sending mechanism 32. Since the tape 11 is sandwiched between the sending roller 32A and the driven roller 32B of the sending mechanism 32, however, the twisted tape 11 being supplied to the downstream side of the sending mechanism 32 can be prevented.

As described above, the controller 38 controls, with namely feedback control, the rotation amount of the mounting stand 20 based on the detection result of the twist detection part 36. The controller 38 may, however, control the rotation amount of the mounting stand 20, with namely feedforward control, to make the mounting stand 20 rotate one time when supplying one lap of the tape 11 of the record wound tape 10. In this case, the controller 38 may rotate the mounting stand 20 according to the supply amount of the tape 11 from the sending mechanism 32 (or a drive amount of the sending mechanism 32), thus the twist detection part 36 does not have to be included. It should be noted that, the rotation amount of the mounting stand 20 can also be controlled by the controller 38 performing feedback control based on the detection result of the twist detection part 36 and performing feedforward control based on the supply amount of the tape 11.

(1) Cable Manufacturing Method

Figure 9:
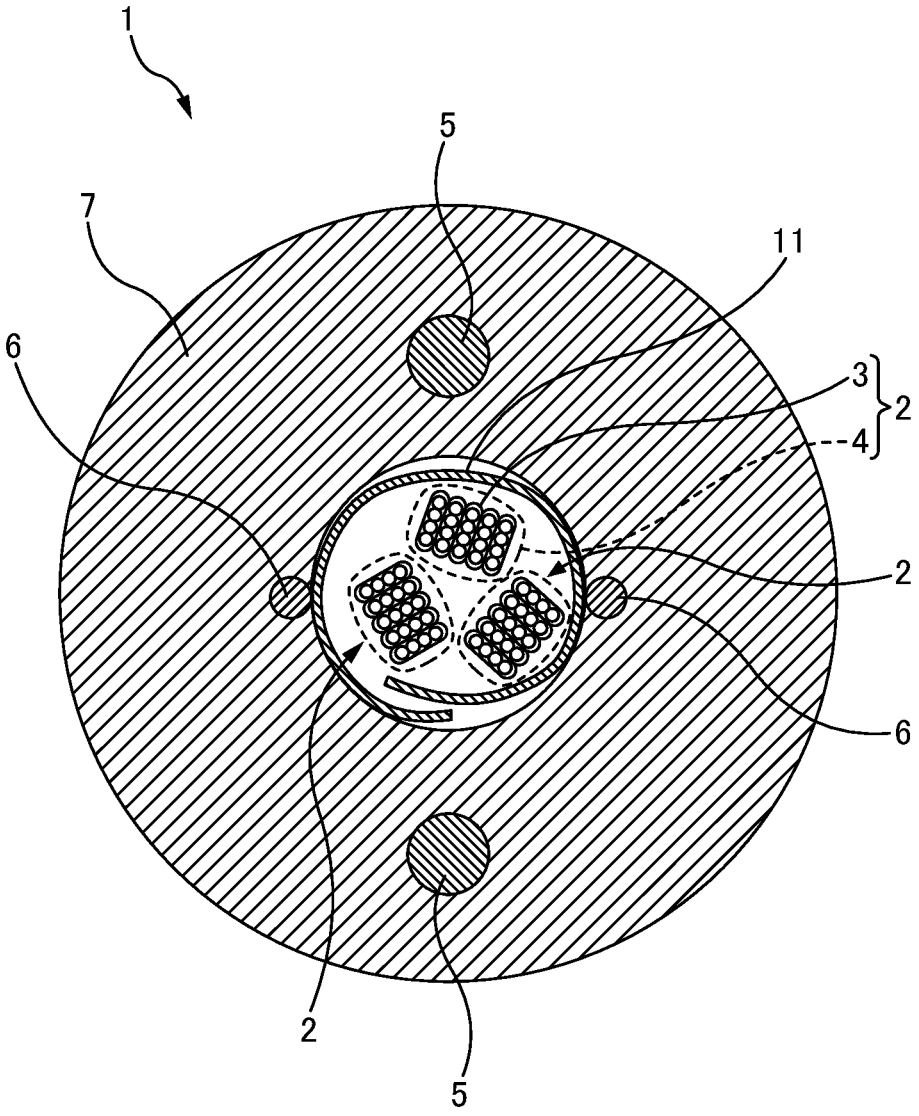
FIG. 9 is a sectional view of an optical cable 1 including the tape 11.
Figure 10:
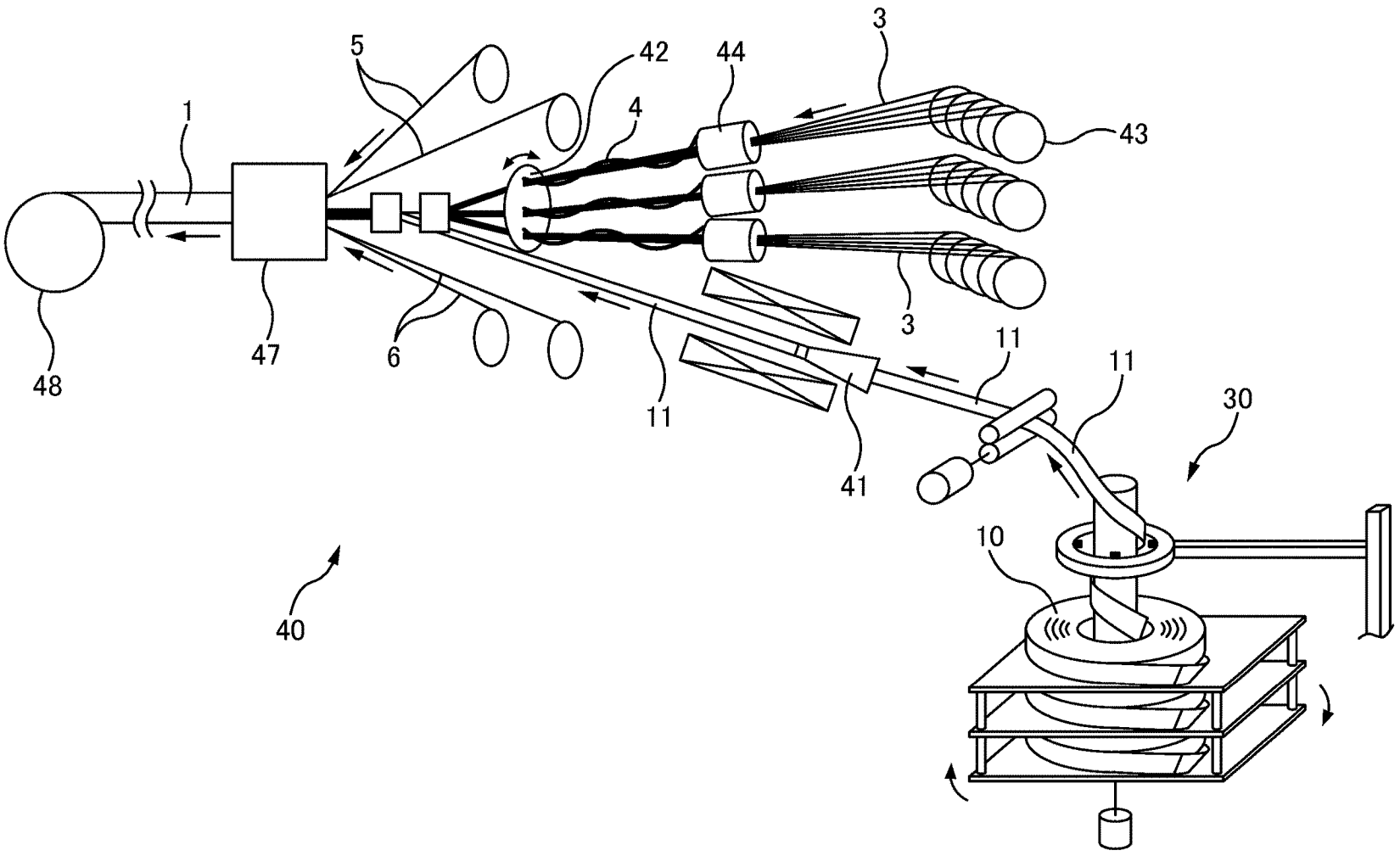
FIG. 10 is a process chart of a manufacturing device 40 of the optical cable 1 using the tape supplying device 30.

FIG. 9 is a sectional view of an optical cable 1 including the tape 11. FIG. 10 is a flowchart of a manufacturing device 40 of the optical cable 1 using the tape supplying device 30 (a manufacturing line).

The optical cable 1 has three optical fiber units 2, a press-wrapping tape 11, and an outer covering (sheath) 7. The press-wrapping tape 11 is the tape 11 that is supplied from the above-described record wound tape 10.

The optical fiber unit 2 is a member that has been made into a unit by wrapping an identification thread 4 around five four-core optical fiber tapes 3. The identification thread 4 is a colored thread with a width of 2 mm× a thickness of 0.1 mm. By making the identification color of the three optical fiber units 3 different from each other, the worker can identify each of the optical fiber units 2. As shown in FIG. 10, a bundle device 44 helically wraps the identification thread 4 around five four-core optical fiber tapes 3 each being supplied from a bobbin 43, and bundles the five four-core optical fiber tapes 3 with the identification thread 4, to configure the optical fiber unit 2. An SZ distribution board 42 reverses the twist rotation direction for every one rotation, to twist the three optical fiber units 2 with the SZ. The three optical fiber units 2 that have been twisted are supplied to an extruding device 47.

The press-wrapping tape 11 is a member to wrap the three optical fiber units 2. In the optical cable 1, the press-wrapping tape 11 is in a spiral shape, and is in an overlapping structure with both end parts in the width direction being overlapped. The press-wrapping tape 11 to be supplied from the above described tape supplying device 30 is inserted into a spiral duct 41 and heated to make the spiral shape. The press-wrapping tape 11 that has been made into the spiral shape is temporarily opened in the extruding device 47, and the three optical fiber units 2 are arranged inside the tape 11, and the tape 11 then returns to the spiral shape to store the three optical fiber units 2.

The press-wrapping tape 11 is configured from, for example, a thermoplastic tape that retains shape by heating. Specifically, for the press-wrapping tape 11, such as a polyimide tape, a polyester tape, a polypropylene tape, and a polyethylene tape is used. Other than the above, a nonwoven fabric may also be used as the press-wrapping tape 11. In this case, as the nonwoven fabric, such as polyimide, polyester, polypropylene, and polyethylene, that has been formed into a tape is used. It should be noted that, the nonwoven fabric may be attached or applied with such as water-absorbing powder, or may be surface processed for the above purpose. The press-wrapping tape 11 may be a nonwoven fabric adhered with a film such as a polyester film. The press-wrapping tape 11 is non-adhering to the inner side optical fiber tape 3 and the outer side outer covering 7, even when heated. This is to make it easy to take out the optical fiber tape 3 (or an optical fiber core wire) from the optical cable 1, during the exposing work in the terminal part of the optical cable 1 and during the mid-span splitting work.

The outer covering 7 is a member to cover the optical fiber units 2 and the press-wrapping tape 11 such that the optical fiber units and the press-wrapping tape are stored inside. The outer covering 7 is provided with tension members 5 and tearing strings 6. The tension members 5 are members that go against contraction of the outer covering 7 and suppress distortion or bending that is applied to the optical cable 1 due to the contraction of the outer covering 7. A pair of the tension members 5 is provided inside the outer covering 7 so as to sandwich the press-wrapping tape 11. The tearing strings 6 are members that are to be used when tearing the optical cable 1 in the longitudinal direction during the branching work of the optical cable 1. The pair of the tearing strings 6 is provided inside the outer covering 7 so as to sandwich the press-wrapping tape 11 along a line orthogonal to a line that connects the pair of the tension members 5.

Three optical fiber units 2 twisted with the SZ, the press-wrapping tape 11 that has been made into the spiral shape, two tension members 5, and two tearing strings 6 are supplied to the extruding device 47. The extruding device 47 feeds the tension members 5 and the tearing strings 6 from each of their supply sources, moves the press-wrapping tape 11 storing the three optical fiber units 2, and covers the periphery of the press-wrapping tape 11 with the outer covering 7. In this way, the optical cable 1 with 60 cores as shown in FIG. 9 is manufactured. The manufactured optical cable 1 is wrapped around a drum 48.

(1) Embodiment

In the above cable manufacturing method, three record wound tapes 10 (press-wrapping tape 11) are set in the tape supplying device 30, and a tape end 12A to the outer side of the upper side record wound tape 10A and a tape end 12B to the inner side of the lower side record wound tape 10B are connected in advance by matching the surface and the rear surface of the tapes 11. One record wound tape 10 is configured of a nonwoven fabric with a width of 20 mm× a thickness of 0.2 mm, and the tape length is approximately 4000 m. In this way, approximately 12000 m (=4000 m×3) of the press-wrapping tape 11 can be directly supplied from the record wound tapes 10 at one time.

Supposing that a twisted press-wrapping tape 11 has been supplied from the tape supplying device 30, then there is a possibility that the press-wrapping tape 11 may get jammed in the spiral duct 41, or the press-wrapping tape 11 that has been arranged bent inside the optical cable 1 may press the optical fiber and the transmission loss may increase. On the contrary, in the above cable manufacturing method, when the press-wrapping tape 11 is supplied from the tape supplying device 30 while solving the twist, the press-wrapping tape 11 did not get jammed in the manufacturing line, and the sending state of the press-wrapping tape 11 was satisfactory. The transmission loss of the optical fiber inside the optical cable 1 was 0.197 dB/km (wavelength 1.55 μm: OTDR method) and was at a normal value.

(2) Second Embodiment (2) Summary

Figure 11B:
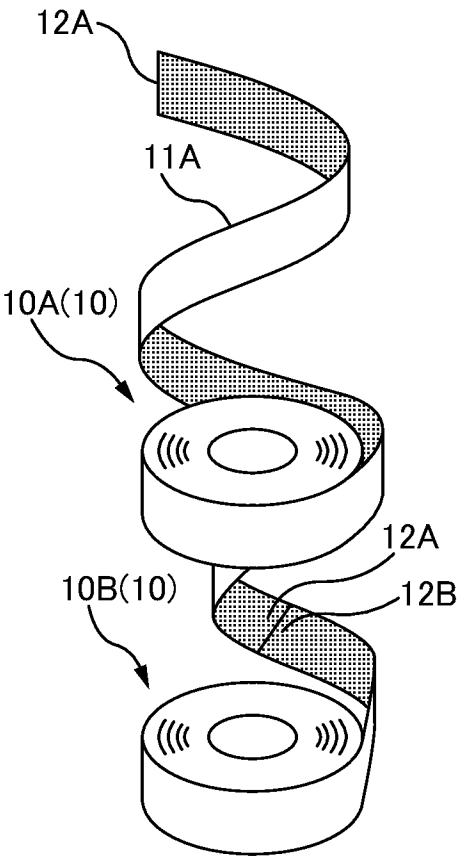
FIG. 11B is an explanatory view of a tape supplying method of two record wound tapes 10 that have been connected as shown in FIG. 11A.
Figure 11A:
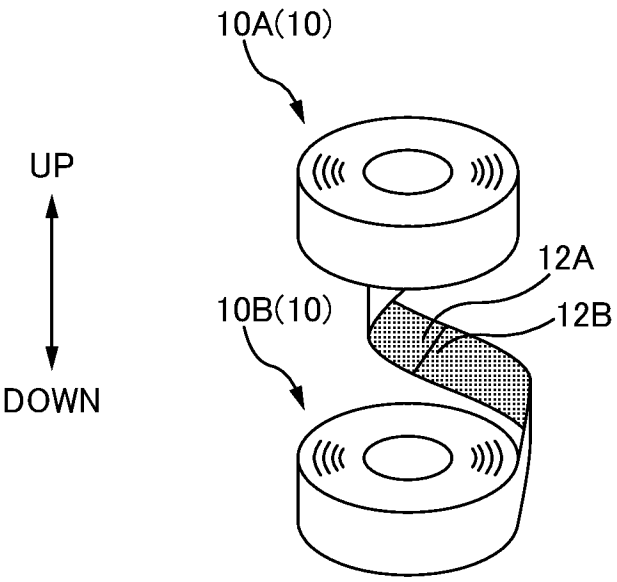
FIG. 11A is an explanatory view of a connecting method of tape ends 12 in a second embodiment.

FIG. 11A is an explanatory view of a connecting method of tape ends 12 of a second embodiment. Here, mounting stands 20 of record wound tapes 10 are not taken into consideration.

Two record wound tapes 10 are arranged to the upper side and the lower side. The tape end 12A to the inner side of the upper side record wound tape 10A is drawn out. The tape end 12B to the outer side of the lower side record wound tape 10B is drawn out. Then, the tape ends 12 are connected together by matching the surface and the rear surface of the tapes 11.

FIG. 11B is an explanatory view of a tape supplying method of two record wound tapes 10 that have been connected as shown in FIG. 11A.

After the two record wound tapes 10 have been connected, the tape end 12A to the outer side of the upper side record wound tape 10A (the tape end 12A to the opposite side to the side that has been connected to the lower side record wound tape 10B) is drawn out upwards, to supply the tape 11A from the outer side of the upper side record wound tape 10A. Then, when the upper side record wound tape 10A has been used up, the tape end 12B to the outer side of the lower side record wound tape 10B (the tape end 12B connected to the upper side record wound tape 10A) is drawn out upwards, and the tape 11B is supplied from the outer side of the lower side record wound tape 10B.

In this way, by connecting the tape ends 12 of the two record wound tapes 10 in advance, even after the upper side record wound tape 10A has been used up, the tape 11B can be supplied continuously from the lower side record wound tape 10B.

(2) Connecting Method of Tape Ends

Figures 12A, 12B, 12C:
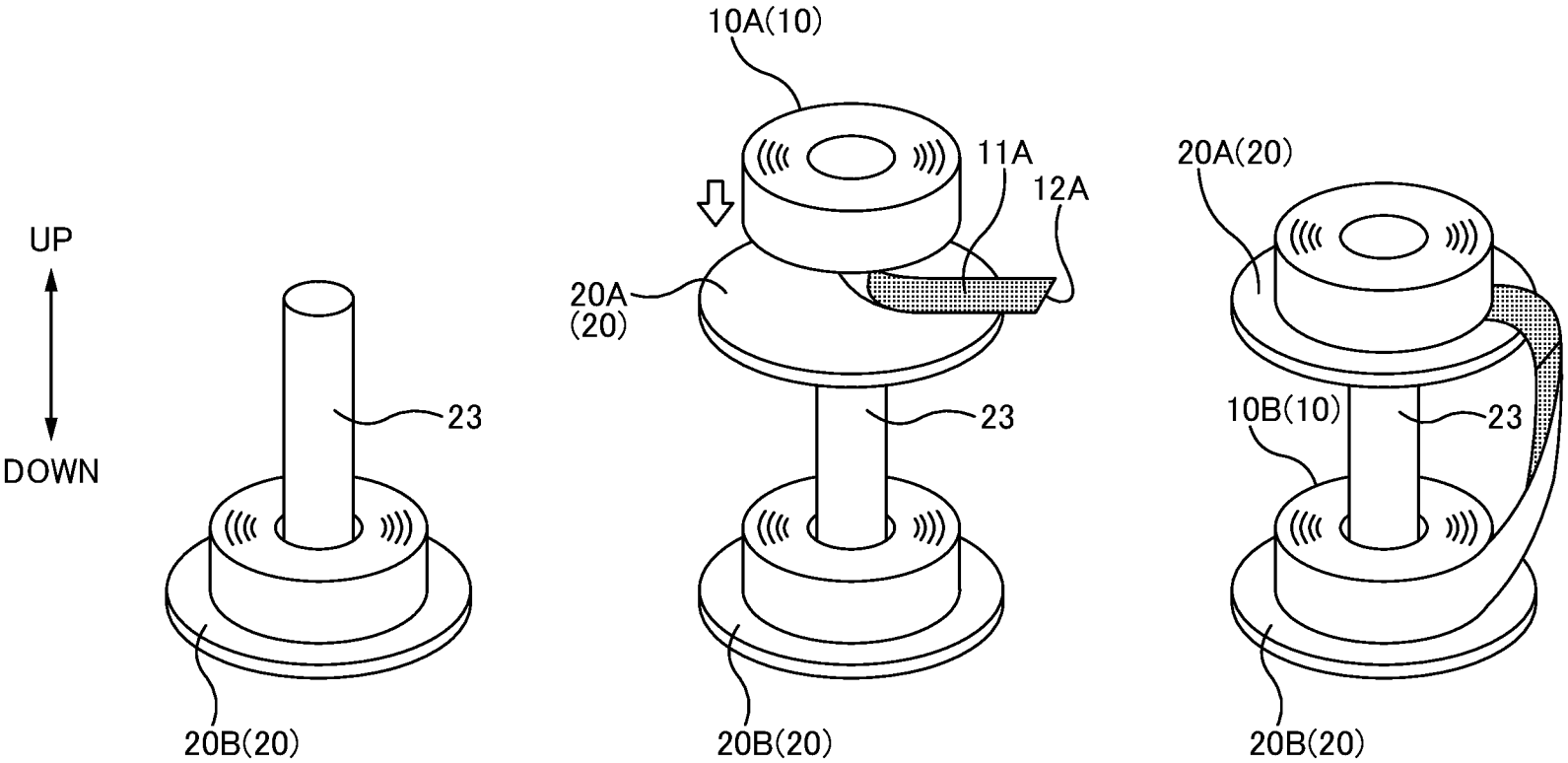
FIG. 12A to FIG. 12C are explanatory views of connecting processes of tape ends 12 in the second embodiment.

FIG. 12A to FIG. 12C are explanatory views of connecting processes of tape ends 12 of the second embodiment.

First, as shown in FIG. 12A, the worker places the record wound tape 10B on a lower side mounting stand 20B. A supporting member 23 to support an upper side mounting stand 20A is formed in the center of the lower side mounting stand 20B. The worker places the record wound tape 10B on the lower side mounting stand 20B, such that the supporting member 23 penetrates through a hollow part of the record wound tape 10B. After the worker has placed the record wound tape 10B, the worker places the upper side mounting stand 20A on the supporting shaft of the lower side mounting stand 20B to support the upper side mounting stand 20A.

Next, as shown in FIG. 12B, the worker places the record wound tape 10A on the upper side mounting stand 20A. At this time, as shown in FIG. 12B, the worker draws out the tape end 12A from the inner side of the record wound tape 10A from the lower side, and places the record wound tape 10A on the upper side mounting stand 20A such that the drawn out tape 11A is sandwiched with the lower surface of the record wound tape 10A. As shown in FIG. 12B, the tape end 12A that has been drawn out from the inner side of the record wound tape 10A is in a state to the outer side from the lower surface of the upper side record wound tape 10A.

Next, as shown in FIG. 12C, the worker connects the tape end 12A to the inner side of the upper side record wound tape 10A (the tape end 12A that is to the outer side from the lower surface of the upper side record wound tape 10A) and the tape end 12B to the outer side of the lower side record wound tape 10B by matching the surface and the rear surface of the tapes 11. In this way, the connecting work of the tape ends 12 is completed.

As shown in FIG. 12C, in this connecting method, the tape ends 12 of the two record wound tapes 10 are to be connected to the outer side the mounting stand 20.

(2) Supplying Method of Tape

Figure 13B:
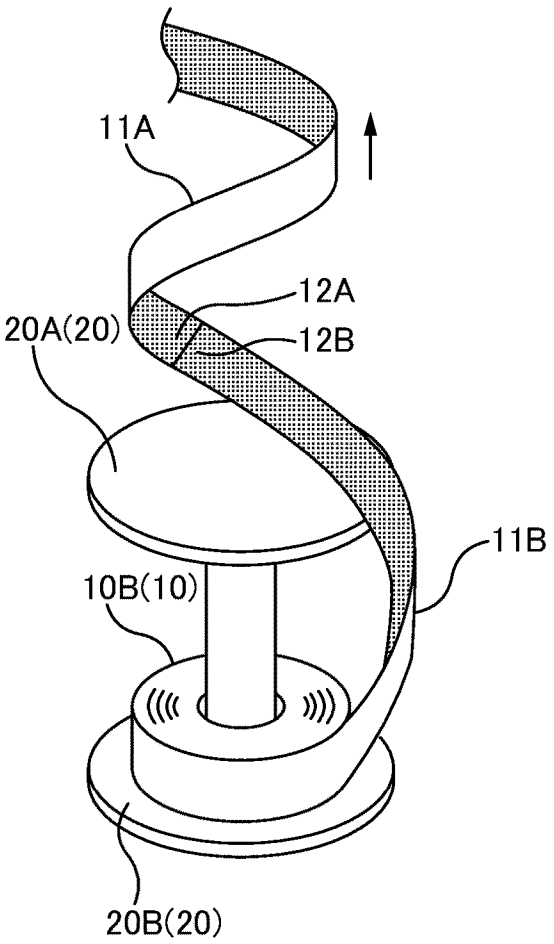
FIG. 13A and FIG. 13B are explanatory views of a supplying method of a tape 11 in the second embodiment.
Figure 13A:
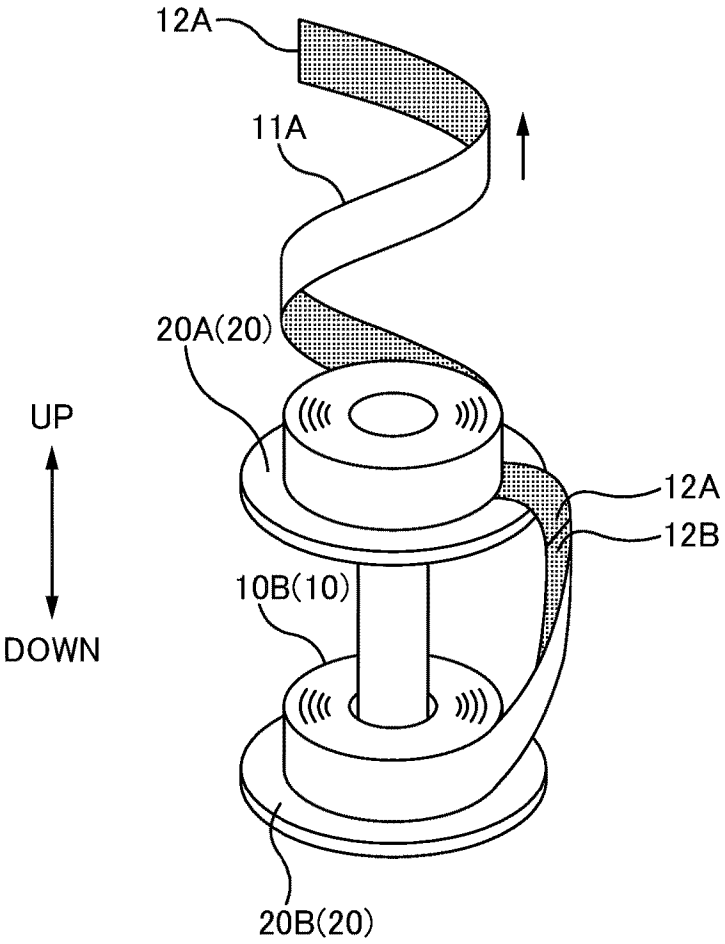

FIG. 13A and FIG. 13B are explanatory views of a supplying method of the tape 11 of the second embodiment.

After the connecting work of the two record wound tapes 10 (refer to FIG. 12C), as shown in FIG. 13A, by drawing out upwards the tape end 12A to the outer side of the upper side record wound tape 10A (the tape end 12A to the opposite side to the side that has been connected to the lower side record wound tape 10B), the tape 11A is supplied from the outer side of the upper side record wound tape 10A.

When the upper side record wound tape 10A is used up, as shown in FIG. 13B, the tape end 12B to the outer side of the lower side record wound tape 10B (the tape end 12B that has been connected to the upper side record wound tape 10A) is drawn out upwards, and the tape 11B is supplied from the outer side of the lower side record wound tape 10B.

At this time, as shown in FIG. 13B, the tape 11B of the lower side record wound tape 10B is drawn out to the upper side than the upper side mounting stand 20, via the outer edge of the upper side mounting stand 20. To make the tape 11 not get caught on the outer edge of the mounting stand 20, the outer edge of the mounting stand 20 preferably does not have corners, and here the mounting stand 20 is a disk-like form. Further, as shown by the dotted lines in FIG. 5A to FIG. 5C described above, when the supporting members 22 are arranged to the outer side of the record wound tapes 10, the tape 11 gets caught by the supporting members 22, thus here the supporting member 23 is arranged to the inner side (the hollow part) of the record wound tapes 10. Further, in order to arrange the supporting member 23 in the hollow part of the record wound tapes 10, the upper and the lower mounting stands 20 are made attachable and detachable as shown in FIG. 12A and FIG. 12B.

As shown in FIG. 13A and FIG. 13B, when the tape 11 is drawn out upwards with the record wound tapes 10 remaining in a fixed state, the tape 11 becomes helical, and a twist is formed in the tape 11. When the tape 11 is supplied while rotating the mounting stands 20, as in the tape supplying device 30 shown in FIG. 6 described above, however, a tape 11 without a twist can be supplied. In this case, with the tape supplying device 30, the mounting stands 20 are to be rotated so as to make the rotation direction of the mounting stands 20 be in the winding direction of the record wound tapes 10 when seen from above.

In the second embodiment, the connecting method and the supplying method of two record wound tapes 10 have been described. Three or more record wound tapes 10 may be arranged in the up-down direction, however, and the record wound tapes 10 adjacent in the up-down direction may be connected similarly as described above, to continuously supply three or more record wound tapes 10 at one time.

(3) Third Embodiment

Figure 14C:
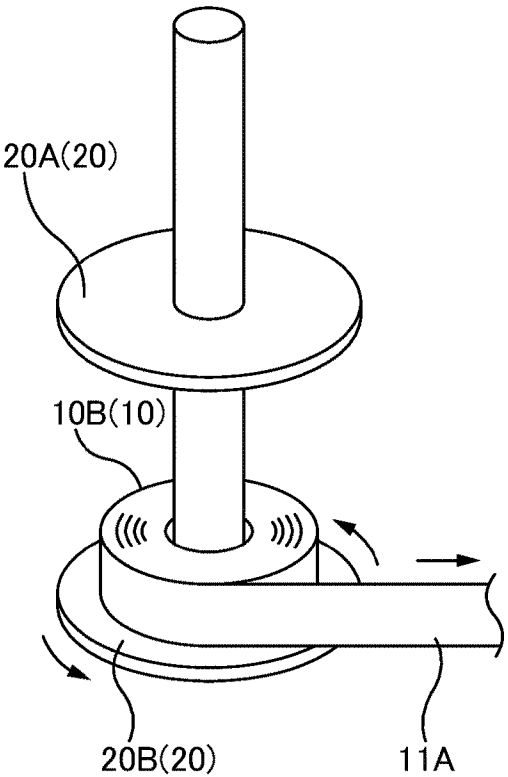
FIG. 14A to FIG. 14C are explanatory views of a supplying method of a tape 11 in a third embodiment.
Figure 14B:
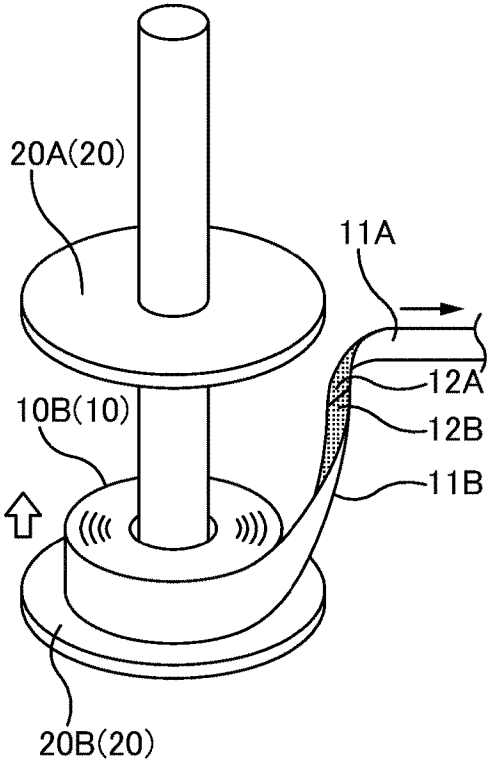
Figure 14A:
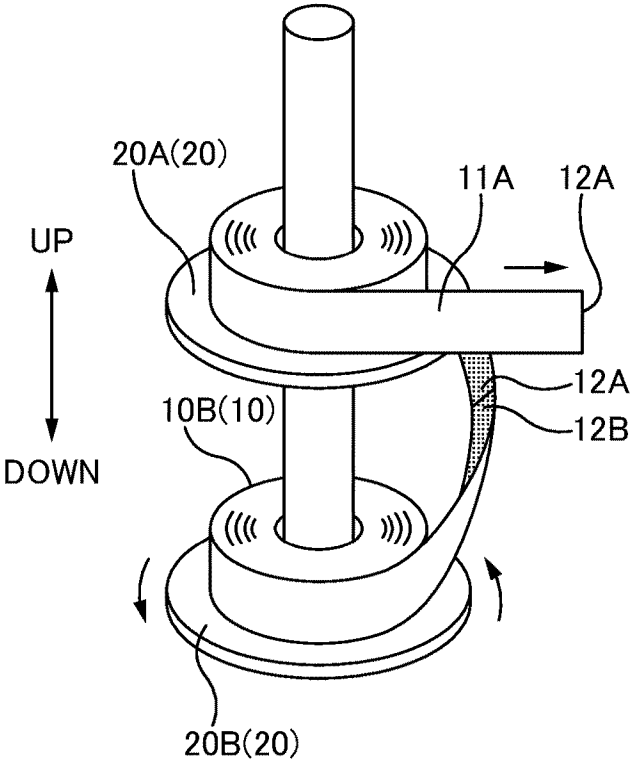

FIG. 14A to FIG. 14C are explanatory views of a supplying method of a tape 11 in a third embodiment. Two record wound tapes 10 are placed on mounting stands 20 as similar to in FIG. 12A to FIG. 12C the described above, and tape ends 12 are connected to each other in advance.

As shown in FIG. 14A, by drawing out horizontally a tape end 12A to an outer side of an upper side record wound tape 10A (a tape end 12A to an opposite side to a side that has been connected to a lower side record wound tape 10B), the tape 11A is supplied from the outer side of the upper side record wound tape 10A.

In the above-described second embodiment, the tape 11 is drawn out upwards, but the third embodiment is different from the second embodiment in that the tape 11 is to be drawn out horizontally (a direction parallel to an upper surface and a lower surface of the record wound tape 10). In the above described second embodiment, the tape 11 can be drawn out with the record wound tape 10 remaining in a fixed state, but in the third embodiment, to draw out the tape 11, a rotation mechanism (not shown) to rotate the record wound tapes 10 (the mounting stands 20) is necessary. Since the tape 11 is drawn out while rotating the record wound tapes 10, a twist is not made in the tape 11.

When the upper side record wound tape 10A is used up, a tape end 12B to an outer side of the lower side record wound tape 10B (the tape end 12B that has been connected to the upper side record wound tape 10A) is drawn out horizontally, and the tape 11B is supplied from the outer side of the lower side record wound tape 10B.

Preferably, at this time, the mounting stand 20 is moved to the upper side as shown in FIG. 14B, and the lower side record wound tape 10B is moved to the height of the upper side mounting stand 20A before moving. In other words, preferably, in respect to the tape supplying device, with the moving mechanism not shown, the lower side record wound tape 10B is moved to the position where the upper side record wound tape 10A had been previously placed. In this way, as shown in FIG. 14C, the position of the source of the tape 11 is fixed, and the tape 11 can be supplied without a slanted curl being made to the tape 11.

In the third embodiment, three or more record wound tapes 10 may be arranged in the up-down direction, and the record wound tapes 10 adjacent in the up-down direction may be connected similar to the above description, in order to continuously supply three or more record wound tapes 10 at one time.

Further, with the third embodiment, the record wound tapes 10 are certainly rotated for the amount corresponding to the length of the tape 11 that is drawn out (a supply amount of the tape 11), thus there is an advantage that compared to the first embodiment and the second embodiment a twist of the tape 11 is certainly not made (on the contrary, in the first embodiment and the second embodiment, a delay in the rotation amount of the record wound tapes 10 with respect to the supply amount of the tape 11 may occur, and a twist may be made to the tape 11.).

Other Points

The above embodiments are to facilitate understanding of this invention, and are not to limit understanding of this invention in any way. This invention may be changed or altered without departing from its scope, and it is needless to say that this invention includes its equivalents.

<Tape Supplying Device>

The above-mentioned tape supplying device had been supplying the press-wrapping tape 11 to be used in manufacturing the optical cable 1. The tape supplying device may be used for other uses, however. For example, the tape supplying device may supply a wrapping tape used for manufacturing a wrapping body, or the tape supplying device may supply a tape-form chip-type electronic component storage board to be used for manufacturing a chip component.

<Regarding Mounting Stand>

One above-mentioned mounting stand has been provided to each record wound tape 10. Two or more record wound tapes 10 may be placed on one mounting stand, however. In this case, for example by placing the upper side record wound tape 10A in FIG. 2A on the upper surface of the lower side record wound tape 10B, the record wound tapes 10 may be stacked. Even when the record wound tapes 10 are directly stacked in this way, the tapes can be continuously supplied, as similar to the case shown in FIG. 2B.

REFERENCE SIGNS LIST

1 optical cable,
2 optical fiber unit,
3 optical fiber tape,
4 identification thread,
5 tension member,
6 tearing string,
7 outer covering,
10 record wound tape (press-winding tape),
11 tape,
12 tape end,
20 mounting stand,
21 opening,
22 supporting member,
23 supporting member,
30 tape supplying device,
32 sending mechanism,
32A sending roller,
32B driven roller,
32C sending motor,
34 rotation mechanism,
36 twist detection part,
36A guiding shaft,
36B guiding ring,
36C detection sensor,
38 controller,
40 manufacturing device,
41 spiral duct,
42 SZ distribution board,
43 bobbin,
44 bundle device,
47 extruding device,
48 drum

The invention claimed is:

1. A tape supplying method comprising:

connecting a tape end to an outer side of one record wound tape of a first record wound tape and a second record wound tape and a tape end to an inner side of another record wound tape, by matching a surface and a rear surface of the tapes; and after the connecting, supplying a tape of the first record wound tape and the second record wound tape from a tape end of the first record wound tape to an opposite side of a side that has been connected to the second record wound tape, wherein:

during the supplying, the tape is supplied by the first record wound tape and the second record wound tape being rotated; and during the supplying, a twist of the tape that has been drawn out in a direction perpendicular to an upper surface and a lower surface of the first record wound tape is detected, and the first record wound tape and the second record wound tape are rotated according to a detection result of the twist.

2. A tape supplying method according to claim 1, wherein during the connecting, the tape end to the outer side of the first record wound tape and the tape end to the inner side of the second record wound tape are connected, and during the supplying, supplying the tape from the first record wound tape, from the tape end to an inner side of the first record wound tape.

3. A tape supplying method according to claim 2, wherein during the connecting, a tape end that has been drawn out from an inner side of the second record wound tape that has been placed on a lower side mounting stand is passed through an opening of an upper side mounting stand, with the tape end of the second record wound tape that has been passed through the opening placed to an outer side from a lower surface of the first record wound tape, the first record wound tape is placed on the upper side mounting stand in a manner sandwiching the tape of the second record wound tape, and the tape end to an outer side of the first record wound tape and the tape end to an inner side of the second record wound tape that is placed to an outer side from a lower surface of the first record wound tape are connected.

4. A tape supplying method according to claim 1, wherein the tape is supplied through an annular gap formed between a guiding shaft that passes through hollow parts of the first record wound tape and the second record wound tape and an annular guiding ring arranged to surround a periphery of the guiding shaft, and the twist of the tape is detected by detecting the tape in the annular gap.

5. A tape supplying method according to claim 1, wherein by sandwiching with a pair of rollers the tape that has been drawn out from one of the first record wound tape and the second record wound tape, when a twist is made in the tape the twist is accumulated to an upstream side of the rollers.

6. A tape supplying method according to claim 1, wherein during the supplying, drawing out the tape in a direction parallel to an upper surface and a lower surface of the first record wound tape from an outer side of the first record wound tape, while rotating the first record wound tape and the second record wound tape, and after the first record wound tape has been used up, the second record wound tape is moved to a position where the first record wound tape had been placed, and while the second record wound tape is rotated, the tape is drawn out from an outer side of the second record wound tape.

7. A tape supplying device comprising:

a mounting stand on which a first record wound tape and a second record wound tape are to be placed;

a sending mechanism to send a tape;

a guiding shaft that passes through hollow parts of the first record wound tape and the second record wound tape;

a guiding ring arranged to surround a periphery of the guiding shaft;

a sensor to detect the tape in an annular gap that has been formed between the guiding shaft and the guiding ring; and a rotation mechanism that rotates the first record wound tape and the second record wound tape, wherein:

a tape end to an outer side of one record wound tape of the first record wound tape and the second record wound tape placed on the mounting stand and a tape end to an inner side of another record wound tape are connected, by matching a surface and a rear surface of the tapes;

the sending mechanism supplies a tape of the first record wound tape and the second record wound tape from a tape end of the first record wound tape to an opposite side of a side that has been connected to the second record wound tape; and while the tape is drawn out in a direction perpendicular to an upper surface and a lower surface of the first record wound tape, the rotation mechanism is driven according to a detection result of the sensor, and the first record wound tape and the second record wound tape are rotated in a direction that solves a twist of the tape.

8. A tape supplying device according to claim 7, wherein a pair of rollers that sandwiches the tape that has been drawn out from one of the first record wound tape and the second record wound tape is provided, and the rollers are rotated to supply the tape.

* * * * *